United States Patent [19]

Cahn

[11] 4,165,670

[45] Aug. 28, 1979

[54] SLIDABLE CAPO

[76] Inventor: Maurice S. Cahn, c/o Dennis L. Deckert, Esq., 330 Washington St., 4th Floor, Marina Del Rey, Calif. 90291

[21] Appl. No.: 821,999

[22] Filed: Aug. 5, 1977

[51] Int. Cl.[2] ..... G10D 3/04

[52] U.S. Cl. ..... 84/318

[58] Field of Search ..... 84/318, 297 R, 312, 84/455

[56] References Cited

U.S. PATENT DOCUMENTS

| | | | |
|---|---|---|---|
| 134,679 | 1/1873 | Knaffl | 84/318 |
| 583,102 | 5/1897 | Utt | 84/318 |
| 3,722,346 | 3/1973 | Valentino | 84/318 |

*Primary Examiner*—Stephen J. Tomsky

*Assistant Examiner*—S. D. Schreyer

*Attorney, Agent, or Firm*—J. B. McGuire

[57] ABSTRACT

A device for eliminating the need for a guitar player to utilize his index finger for fretting guitar strings at different frets. A preferred embodiment comprises a metallic frame having three sections extending equiangularly from a central, common edge. A second element may comprise a barr which may be placed in contact with the strings on a guitar and held tightly thereagainst by means of a tension-exerting member which releasably grips the ends of the barr and is passed across one section of the frame. The frame may comprise a single metallic element constructed in one or more various shapes. Preferably, both the frame and the barr are at least partially covered with a low friction, relatively soft material, such as Teflon.

10 Claims, 7 Drawing Figures

FIG. 5
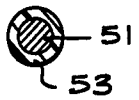
FIG. 1
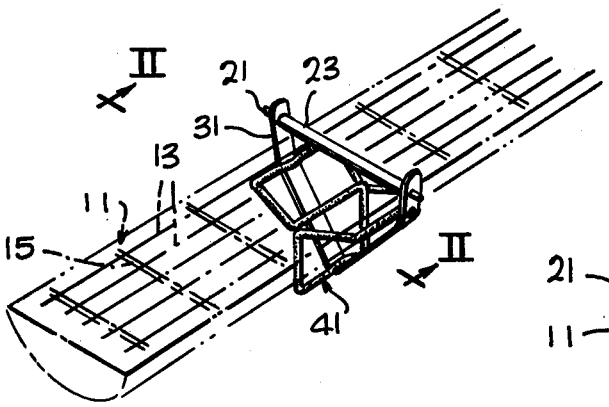
FIG. 2
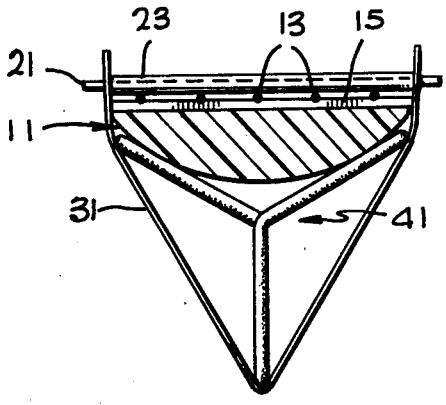
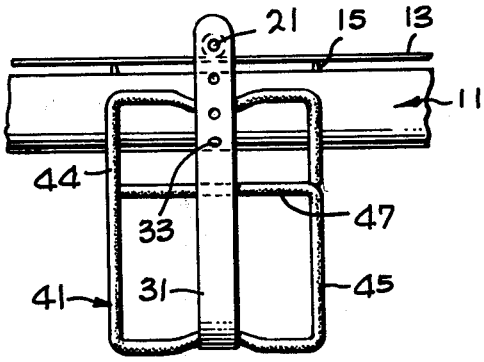
FIG. 3
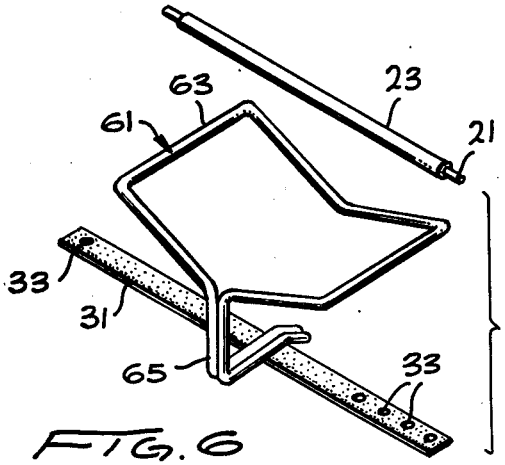
FIG. 6
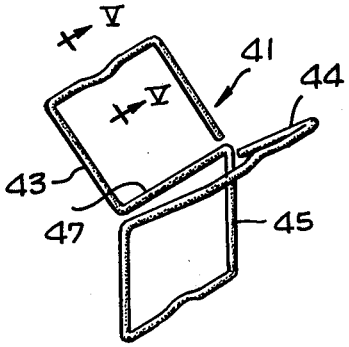
FIG. 4
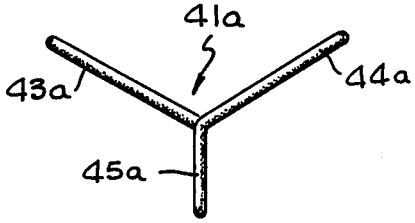
FIG. 7

SLIDABLE CAPO

BACKGROUND OF THE INVENTION

When playing a guitar, it is often desirable to change the natural or unfretted key of the guitar strings in order to produce a sound of higher or lower frequency as the strings are plucked or strummed. This is normally accomplished by the act of "fretting" the strings against the neck of the guitar. The guitar neck is usually provided with a series of thin metal strips extending perpendicular to the axis of the neck, against which the strings may be forced, either individually or as a group. This action is known as "fretting." The action changes the effective length of the strings so that vibration of each string will result in a sound of a predetermined frequency, different from every other sound which will be generated when the string is forced against any other fret.

In the past, many guitar players have produced such fretting by employing a device known as a "capo." In general, such capos generally comprise a barr which can be pressed against the strings of the guitar at a selected position along the length of the neck. The barr is usually held in place by an elastic band or other tying device which prevents movement of the barr relative to the neck. When the capo is mounted on the neck of the guitar, it presses the strings against the next lower fret so that each time one of the strings is plucked, it will produce a sound of predetermined frequency depending upon the fret selected, unless it is also individually fretted at a lower position by a finger of the player. In other words, a capo will effectively change the tuning of the guitar without requiring that each string be individually retuned.

When certain musical selections are played, however, it is sometimes desirable to fret all of the strings at a predetermined position only temporarily and to relieve that fretting after a selected number of notes or chords have been played. In such cases, it has become common for players to utilize the index finger of the hand which controls the fretting of the strings to accomplish a fretting of all the strings at a predetermined position. While this is accomplished, the remaining three fingers of the hand may be used to individually fret up to three of the strings at lower positions.

Unfortunately, not all players find it comfortable or convenient to accomplish such index finger fretting. Many have difficulty arranging their hands and arms in such a way that their index fingers can be properly positioned to accomplish the fretting, while allowing their remaining three fingers to curve sufficiently to achieve independent string fretting without touching any of the other strings and reducing the quality of the sound of such other strings. Further, many players find it undesirable to fret all of the strings with their index finger, preferring to use four fingers instead to fret individual strings. Accordingly, it has become desirable to provide a device which will allow the player to achieve the versatility of both index finger fretting and the sounds which can be achieved utilizing a capo.

PRIOR ART STATEMENT

There have been some prior devices which have attempted to yield such versatility for playing a guitar. For example, U.S. Pat. No. 134,679 to Knaffl discloses a foot-actuated string tensioning device which allows the player to move a roller up and down the "fretboard" or neck of the guitar by stepping on and releasing pressure from a treadle. Unfortunately, that device required major modifications to be made to the guitar; the device was so complex as to be difficult to control and maintain; it also adversely affected the sound emanating from the instrument as it was played.

U.S. Pat. Nos. 583,102 to Utt and 743,054 to Bergren also disclosed additional attempts to produce such guitar playing versatility. Both patentees disclose the use of a fretting roller which may be held against the strings and upper surface of the neck of a guitar in order to simultaneously fret all of the strings at any selected position along the neck.

In Bergren, the patentee disclosed that the barr could be held tightly against the strings by means of a frame positionable against the bottom of the neck by means such as rollers, groove following devices, etc.

On the other hand, Utt disclosed a relatively simple frame to which the fretting barr could be releasably attached. The barr could be biased against the spring by means of an endless rubberband. Utt also disclosed that the frame, against which the rubber band would be located, could be provided with a lining to bear against the under surface of the neck to avoid marring the latter as the frame was moved longitudinally along the neck.

Schuster, in U.S. Pat. No. 577,627, disclosed a guitar string adjuster which could be employed selectively to position a fretting barr along the neck of the guitar. When desired, the fretting barr could be biased against the guitar string by means of a hand-actuated lever acting through the frame.

The devices disclosed by Utt, Bergren, and Schuster are also unsatisfactory for solving the present problem. Bergren and Schuster have disclosed relatively complex expensive, and difficult to use devices. The devices disclosed by all three patentees, in addition, are unsatisfactory for solving the problem with which the present invention is concerned. While each device can be employed with a specific guitar (given any selected configuration, dimensions, etc.) it cannot, in general, be used with all guitars, regardless of size or configuration. In other words, none of those devices could be universally employed and several different sizes of each would have to be produced and inventoried in order to make them universally useful.

SUMMARY OF THE INVENTION

The present invention relates to a device which is vaguely similar to those of the prior art, but which is of much greater simplicity and is capable of being employed with any currently available stringed instrument having frets at spaced intervals along a finger board.

In its presently preferred embodiment, the device may comprise a bracket including a frame formed of solid or tubular material which can be operatively located against the back or undersurface of a guitar neck or finger board. A second or lower frame, which may be integral with and extend from the bracket, may be positioned so that it extends outwardly from the first or upper frame when the latter is positioned against the guitar neck. The second frame may be utilized by the player to move the first frame up and down a guitar neck by means of his thumb. That second frame may also be used to locate and properly tension an elastic or other biasing strip material. This latter material may be releasably attached to the ends of a fretting barr, located on the front or upper side of the guitar neck finger board, in contact with all of the guitar strings.

Preferably, the upper frame, at least, may be provided with a suitable coating of any friction reducing material, such as Teflon. This material may prevent the bracket from actually contacting the guitar neck, but will allow the device to be readily moved up and down the guitar neck as the instrument is played. Similarly, if desired, the barr may be covered with similar friction reducing material, both to improve the slidability of the barr as well as to prevent any dischordant sounds from emanating from the strings as the barr is moved up and down the neck.

In one presently preferred embodiment, the bracket may comprise a pair of rectangularly shaped sections, having a common side to form the upper frame. Preferably, the edges of these sections which may be joined along a common side or edge may extend away from one another at an oblique angle of approximately 120°. Also extending away from the common edge or side may be a second or lower section or frame having substantially the same rectangular outline. If desired, one of the rectangular outlines may have a shorter side than the others, thus allowing the device to be used with a guitar having a relatively large neck or with a guitar having a relatively narrower neck. In either case, the degree of tensioning of the barr will be substantially the same since the length of the biasing element will be approximately the same.

In all of the presently preferred embodiments, the bracket may be produced from a single, elongated element, such as a wire, rod, or tube, which may be bent at predetermined locations to form a desired configuration.

Having now described the general features of the present invention, the concepts thereof will be more specifically exemplified in the following detailed description with reference to the accompanying drawing. Nonetheless, it should be borne in mind that the scope of the present invention is limited not by these examples of preferred embodiments, but, rather, by the claims.

BRIEF DESCRIPTION OF THE DRAWINGS

FIG. 1 comprises a perspective illustration of a device formed in accordance with the present invention, depicted in its preferred method of use upon a guitar neck;

FIG. 2 comprises an end view of the device shown in FIG. 1, taken along a line II—II in FIG. 1;

FIG. 3 comprises a side view of the device shown in FIG. 1;

FIG. 4 comprises a perspective illustration of a bracket formed in accordance with a preferred embodiment of the invention;

FIG. 5 comprises a sectional view of a portion of the bracket shown in FIG. 4, as seen along a line V—V;

FIG. 6 comprises an exploded perspective view of a second preferred embodiment of structure employing the present invention; and FIG. 7 comprises an end view of a third preferred embodiment of a bracket which may be utilized in accordance with the present invention.

DETAILED DESCRIPTION

As shown in FIG. 1, there is illustrated in phantom a guitar neck 11 having a plurality of strings 13 extending parallel to the axis of the neck and a plurality of frets 15 which extend substantially perpendicular to the neck across the upper surface or finger board thereof. As is well known, a player of the guitar may push a string against the finger board with a finger. That action causes that string to be "fretted," since its effective length is adjusted by its contact with the fret 15 next closer to the sound box of the guitar than the player's finger.

At times, the guitar player desires to fret all of the strings simultaneously in order to effectively alter the key to which the guitar is tuned, at least on a temporary basis. He is then able to individually fret some of the strings in order to create certain desired additional chords. In the past, such uniform fretting has been accomplished in one of two ways, depending upon the length of time such key alteration was required.

For example, if the operator desired to alter the guitar key for a relatively short period of time, less than the length of a song, for example, the fretting might have been accomplished by means of his index finger. On the other hand, if the key was to be changed for the entire length of a song, the operator could either retune all of the strings on an individual basis, or else employ a device known as a capo which could be temporarily mounted on the neck. Alternatively to both of these methods, the player might employ a sliding capo which could be employed at various positions along the length of the neck as desired by the operator and for any length of time.

As shown in FIGS. 1–5, a new and improved sliding capo may comprise a barr 21 which is long enough to extend entirely across and, preferably, beyond the sides of the guitar neck at the widest point thereof. In this embodiment, the barr may be of any desired cross-sectional configuration and may be provided with a protective coating or cover 23 which is arranged so as to contact the strings 13 of the guitar. For example, the coating 23 may, if desired, be Teflon or some similar material which will not generate sound, to any significant degree, in the strings as it is moved up and down along the strings. Also, in this preferred embodiment, the barr and its coating may be flexible, to at least a very slight degree, so as to avoid damaging the strings as it is moved up and down the neck of the guitar.

In order to provide suitable tensioning on the ends of the barr 21 to pull it tightly against the strings 13, an elastic band or similar biasing device 31 may be provided with one or more openings 33 at each end thereof. Thus, the openings can be selectively installed over the ends of the barr 21 as illustrated.

Suitable tension within element 31 may be produced by means such as a bracket or slide 41 positioned against the undersurface of the guitar neck 11 and located so that element 31 can be stretched across the bracket. Thus, bracket 41, element 31, and barr 21 each cooperates with the others both to hold the device onto the guitar and to allow the device to move up and down the neck as the player desires.

For this latter result, as shown in FIGS. 4 and 5, bracket 41 may be formed from an elongated rod, wire, or tube 51 bent at predetermined locations to form three generally similar or identical rectangular (e.g., square) sections 43, 44, and 45. These three sections may, if desired, share a common edge 47. In order to further strengthen the bracket, the corners of the three sections may be fixed together, such as by welding, at each end of the common edge 47.

Using this very simple structure, any two of the three sections, such as 43 and 44, may be placed against the undersurface of a guitar neck, thus forming an upper frame. If the three sections are substantially equiangularly related about edge 47, the remaining section (e.g., 45) will extend away from the guitar neck in a direction generally perpendicular thereto, forming a second or lower frame. Consequently, when element 31 is connected to the ends of barr 21 across the outer edge of section 45, proper selection of openings 33 will result in tension sufficient to fret the strings while still allowing the device to be moved along the guitar neck by the player. If desired, the outer edge of each section 43–45 may be provided with a slight, inward depression (FIGS. 2 and 4) to maintain the element 31 in a substantially fixed position relative to the bracket.

In order to facilitate movement of the bracket along a guitar neck without scratching or marring the latter, the elongated, bracket forming element 51 may be provided with distinct tubular covers or a unitized coating 53 of slippery, low friction material such as Teflon. Not only will such a coating facilitate movement of the bracket and prevent the element 51 from actually contacting the guitar; it will also protect the bracket from corrosion, etc.

The lower frame may, if the player desires, be used as a thumb guard. Thus, the player can slide the barr up and down the guitar neck merely by using his thumb in the lower frame 45 and pushing in one direction or the other.

As shown in FIG. 7, two bracket sections **43*a* and 44*a* may, if desired, be of a different size than a third bracket section 45*a*. If desired, the three sections could each extend a different radial distance from the central, common edge. Thus, in the illustrated alternate embodiment, any section may be used as the lower frame and the remaining two sections may be used as the upper frame. As a result, if the guitar neck with which this device is to be employed is relatively narrow, the section 45*a* may be employed with either of the other sections to bear against the undersurface of the neck. The remaining section will then form a lower frame across which the elastic member 31** may be stretched.

Stated another way, if it is desired that a single device be employable with guitar necks of a variety of cross-sectional dimensions, a device formed in accordance with the embodiment shown in FIG. 7 may be employed with such a variety of guitar neck sizes. Such a bracket may be so used merely by rotating the bracket **41*a*** 120° about the axis along which all of the frame sections have a common edge.

Referring now to FIG. 6, there is shown an additional embodiment of the invention, although those elements which are identical to the elements described with reference to the previous embodiments have been provided with identical identification numerals. Consequently, no further description of those elements is necessary here. However, the bracket 41 of the previous embodiment, may be replaced by a bracket 61 which, again, may be formed from a single rod or tube having an outer covering (e.g., Teflon). As illustrated here, the bracket 61 may comprise an upper frame 63 which may bear against the undersurface of the guitar neck and a lower frame 65 to receive the thumb of a guitar player and provide a stretch support for element 31. With this embodiment, the guitar player can move the element in one direction by pushing his thumb against an edge of the lower frame 65. He can move the device in the other direction by pushing against one end of the barr with the side of his index finger which is located at the guitar neck.

Having now reviewed this detailed description of these preferred embodiments of the invention, those skilled in the art will realize that this invention may be employed in a wide variety of structures, many of which may not even resemble that described here. Nevertheless, those structures will employ the concepts of the present invention, including its simplicity and novel utility, without departing from the scope of the invention as set forth in the following claims.

I claim:

1. A slidable device for fretting a set of guitar strings at different positions along the length of the neck of a guitar comprising a bracket means including upper frame means positionable adjacent the undersurface of a guitar neck and having means for prohibiting direct contact between said upper frame means and the neck of such a guitar and for facilitating relative movement between said upper frame means and the neck of such a guitar, and lower frame means extending from said upper frame means in such a direction as to be substantially perpendicular to the undersurface of such a guitar neck when said upper frame means is positioned adjacent the undersurface of such a guitar neck wherein said bracket means comprises a single element configured such that said upper and lower frames are formed so that said upper frame is substantially closed about its periphery and said lower frame is open along at least one edge thereof;

barr means of a length greater than the width of said upper frame means and including means for contacting the strings of a guitar on the upper surface of the neck thereof, such contacting means being slidable relative to such strings with the generation of only substantially inaudible levels of noise in such strings during such sliding; and means, releasably fixable to the opposite ends of said barr means and passing over said lower frame means, for exerting a force on said barr means sufficient to fret the strings of a guitar against which said barr may be placed at any position along the length of the neck of a guitar.

2. A slidable device for fretting a set of guitar strings at different positions along the length of the neck of a guitar comprising bracket means including upper frame means positionable adjacent the undersurface of a guitar neck and having means for prohibiting direct contact between said upper frame means and the neck of such a guitar and for facilitating relative movement between said upper frame means and the neck of such a guitar, and lower frame means extending from said upper frame means in such a direction so as to be substantially perpendicular to the undersurface of such a guitar neck when said upper frame means is positioned adjacent the undersurface of such a guitar neck wherein said bracket means comprises a single element configured such that said upper and lower frames are formed as three rectangular sections having a common edge;

barr means of a length greater than the width of said upper frame means and including means for contacting the strings of a guitar on the upper surface of the neck thereof, such contacting means being slidable relative to such strings with the generation of only substantially inaudible levels of noise in such strings during such sliding; and means, releasably fixable to the opposite ends of said barr means and passing over said lower frame means, for exerting a force on said barr means sufficient to fret the strings of a guitar against which said barr may be placed at any position along the length of the neck of a guitar.

3. The device of claim 2 wherein said three rectangular sections are unequal in size.

4. A slidable device for fretting a set of guitar strings at different positions along the length of a guitar neck comprising a bracket means including upper frame means positionable against the unmodified undersurface of a guitar neck and having means for prohibiting direct contact between said upper frame means and the neck of such a guitar to prevent scratching the latter and for facilitating relative movement between said bracket means and the neck of such a guitar, and lower frame means extending from said upper frame means in such a direction as to be substantially perpendicular to the undersurface of such a guitar neck when said upper frame means is positioned adjacent the undersurface of such a guitar neck, said lower frame means being of such a size as to facilitate the placement of his thumb thereagainst by a guitar player for easy movement of said bracket means up and down the neck of such a guitar;

said bracket means further comprising an elongated means having bends at predetermined locations therein for integrally forming said upper and lower frames including a plurality of parallel edges, at least two of which parallel edges are locatable adjacent the undersurface of a guitar neck and at least one of said parallel edges is located away from both of said at least two parallel edges a distance sufficient to require a force exerting means to be stretched thereacross when it is attached to the opposite ends of a barr means;

barr means of a length greater than the width of said upper frame means and including means for contacting the strings of a guitar on the upper surface of the neck thereof, such contacting means being slidable relative to such strings with the generation of only substantially inaudible levels of noise in such strings during such sliding; and means, releasably fixable to the opposite ends of said barr means and passing over said at least one parallel edge of said lower frame means, for exerting a force on said barr means sufficient to fret the strings of a guitar against which said barr may be placed at any position along the length of the neck of a guitar.

5. The device of claim 4 wherein said contact prohibiting means comprises a material having relatively low friction characteristics.

6. A device for rapidly altering the musical key of a guitar during the playing of a tune thereon comprising a barr of a length greater than the neck width of a guitar;

means for exerting a biasing force on said barr to cause fretting of the strings of a guitar and having means releasably attachable to the opposite ends of said barr; and means for movably supporting said barr and force exerting means relative to the guitar neck comprising an elongated means having bends at predetermined locations therein for forming a plurality of integral frames including a plurality of parallel edges, at least two of which parallel edges are locatable adjacent the undersurface of a guitar neck and at least one of said parallel edges is located away from both of said at least two parallel edges a distance sufficient to require said force exerting means to be stretched thereacross when it is attached to the opposite ends of said barr.

7. The device of claim 6 wherein said plurality of integral frames comprises three rectangular sections having a common edge.

8. The device of claim 7 wherein said at least one parallel edge comprises a thumb-receiving means for controlling the longitudinal position of said device relative to the neck of a guitar.

9. The device of claim 7 wherein at least one of said rectangular sections is smaller than the others.

10. The device of claim 6 wherein said plurality of integral frames comprise an upper frame seatable against the undersurface of a guitar neck and a lower frame extending away from said upper frame for such stretching of said force exerting means and for receipt of a player's thumb for movement of said device along a guitar neck during the playing of a tune.

* * * * *